US008970641B2

(12) United States Patent
Pyeon

(10) Patent No.: US 8,970,641 B2
(45) Date of Patent: Mar. 3, 2015

(54) DISPLAY DEVICE

(75) Inventor: Myung-Jin Pyeon, Gimpo-si (KR)

(73) Assignee: LG Display Co., Ltd., Seoul (KR)

( * ) Notice: Subject to any disclaimer, the term of this patent is extended or adjusted under 35 U.S.C. 154(b) by 275 days.

(21) Appl. No.: 13/311,844

(22) Filed: Dec. 6, 2011

(65) Prior Publication Data

US 2012/0162282 A1 Jun. 28, 2012

(30) Foreign Application Priority Data

Dec. 28, 2010 (KR) ..... 10-2010-0136609

(51) Int. Cl.

| | |
|---|---|
| ***G09G 5/10*** | (2006.01) |
| ***G09G 5/00*** | (2006.01) |
| ***G09G 3/20*** | (2006.01) |
| *G09G 3/36* | (2006.01) |

(52) U.S. Cl.

CPC .. *G09G 3/20* (2013.01); *G09G 3/36* (2013.01); *G09G 2310/08* (2013.01); *G09G 2330/06* (2013.01); *G09G 2360/16* (2013.01); *G09G 2370/08* (2013.01)

USPC ..... 345/690; 345/204

(58) Field of Classification Search

USPC ..... 345/204, 214, 690, 76; 358/3.01

See application file for complete search history.

(56) References Cited

U.S. PATENT DOCUMENTS

| | | | | |
|---|---|---|---|---|
| 6,628,262 | B2 * | 9/2003 | Ichiraku | 345/100 |
| 7,403,184 | B1 | 7/2008 | Moon | |
| 8,487,968 | B2 * | 7/2013 | Kim et al. | 345/690 |
| 2005/0179625 | A1 * | 8/2005 | Choi et al. | 345/76 |
| 2005/0200615 | A1 * | 9/2005 | Lin | 345/204 |
| 2007/0268524 | A1 * | 11/2007 | Nose et al. | 358/3.01 |
| 2008/0252635 | A1 * | 10/2008 | Kim et al. | 345/214 |

FOREIGN PATENT DOCUMENTS

| | | |
|---|---|---|
| CN | 101414450 A | 4/2009 |
| JP | 05-100632 A | 4/1993 |

OTHER PUBLICATIONS

Office Action issued in counterpart Korean Patent Application No. 10-2010-0136609 dated May 8, 2013.

Office Action dated Jan. 6, 2014 from the State Intellectual Property Office of China in counterpart Chinese application No. 201110459928.2. Note: USPN 6,628,262, 2005/0200615, 2005/0179625, as well as JP 05-100632 cited therein are already of record.

* cited by examiner

*Primary Examiner* — Seok Yun Moon
*Assistant Examiner* — Peijie Shen
(74) *Attorney, Agent, or Firm* — Morgan, Lewis & Bockius LLP

(57) ABSTRACT

Disclosed is a display device that reduces a data transmission frequency, thereby minimizing generation of EMI noise and realizing high resolution. The display device includes a display panel to display images, a gate driver to drive gate lines of the display panel, a data driver to drive data lines of the display panel, a timing controller to control the gate driver and the data driver and to arrange and supply display data to the data driver, and N (N is a natural number greater than 1) data ports to transmit the display data while being synchronized with N low-speed clock signals having a lower frequency than a clock signal necessary to transmit the display data in the timing controller.

9 Claims, 5 Drawing Sheets

DISPLAY DEVICE

This application claims the benefit of Korean Patent Application No. 2010-00136609, filed on Dec. 28, 2010, which is hereby incorporated by reference as if fully set forth herein.

BACKGROUND OF THE INVENTION

1. Field of the Invention

The present invention relates to a display device, and more particularly, to a display device that reduces a data transmission frequency, thereby minimizing generation of electromagnetic interference (EMI) and noise and realizing high resolution.

2. Discussion of the Related Art

Generally, a liquid crystal display is one of the flat panel display devices that display images using liquid crystals. A liquid crystal display has advantages in that the liquid crystal display is thinner and lighter and has lower driving voltage and power consumption than the other display devices. For this reason, the liquid crystal display has been widely used over the whole range of industry.

It is required for such a liquid crystal display to transmit a large amount of data at high speed and display high-resolution images so as to satisfy user demands for high-quality images. For this reason, the liquid crystal display transmits display data using a high-speed clock with the result that a frequency of the liquid crystal display is increased, and therefore, noise due to EMI may be generated. In particular, in a mobile liquid crystal display using a mobile industry processor interface (MIPI) to transmit data at high speed, noise is excessively generated.

Also, a reference clock signal necessary to transmit data so as to realize a high resolution of WVGA (wide video graphic array) on a mobile display at 60 Hz must have a frequency of 25 MHz (=480 (horizontal resolution)×864 (vertical resolution)×60 Hz (frame frequency)). However, a rated range of the clock necessary to transmit data to the mobile industry processor interface is 12.3 MHz to 20 MHz. For this reason, a mobile liquid crystal display using the mobile industry processor interface has a problem in that it is not possible to realize a high resolution of WVGA.

SUMMARY OF THE INVENTION

Accordingly, the present invention is directed to a display device that substantially obviates one or more problems due to limitations and disadvantages of the related art.

An object of the present invention is to provide a display device that reduces a data transmission frequency, thereby minimizing generation of EMI noise and realizing high resolution.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a display device includes a display panel to display images, a gate driver to drive gate lines of the display panel, a data driver to drive data lines of the display panel, a timing controller to control the gate driver and the data driver and to arrange and supply display data to the data driver, and N (N is a natural number greater than 1) data ports to transmit the display data while being synchronized with N low-speed clock signals having a lower frequency than a clock signal necessary to transmit the display data in the timing controller.

Specifically, the timing controller may include a clock conversion unit to generate the first and second low-speed clock signals having a frequency equivalent to half that of the clock signal necessary to transmit the display data, a data division unit to divide the display data into first and second display data, a color management unit to convert the first and second display data based on color management data, and an average picture level/pixel processing algorithm unit to adjust brightness components of the first and second display data and to arrange and transmit the first and second display data to the data driver.

Meanwhile, first and second data ports may be formed between the data division unit and the color management unit and between the color management unit and average picture level/pixel processing algorithm unit, respectively, the first data port may transmit the first display data while being synchronized with the first low-speed clock signal, and the second data port may transmit the second display data while being synchronized with the second low-speed clock signal.

The first low-speed clock signal may have a phase identical to or reverse to that of the second low-speed clock signal.

Meanwhile, the data division unit may divide the display data into the first display data including first to m/2-th display data and the second display data including (m/2)+1-th to m-th display data. Alternatively, the data division unit may divide the display data into the first display data including odd display data and the second display data including even display data.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
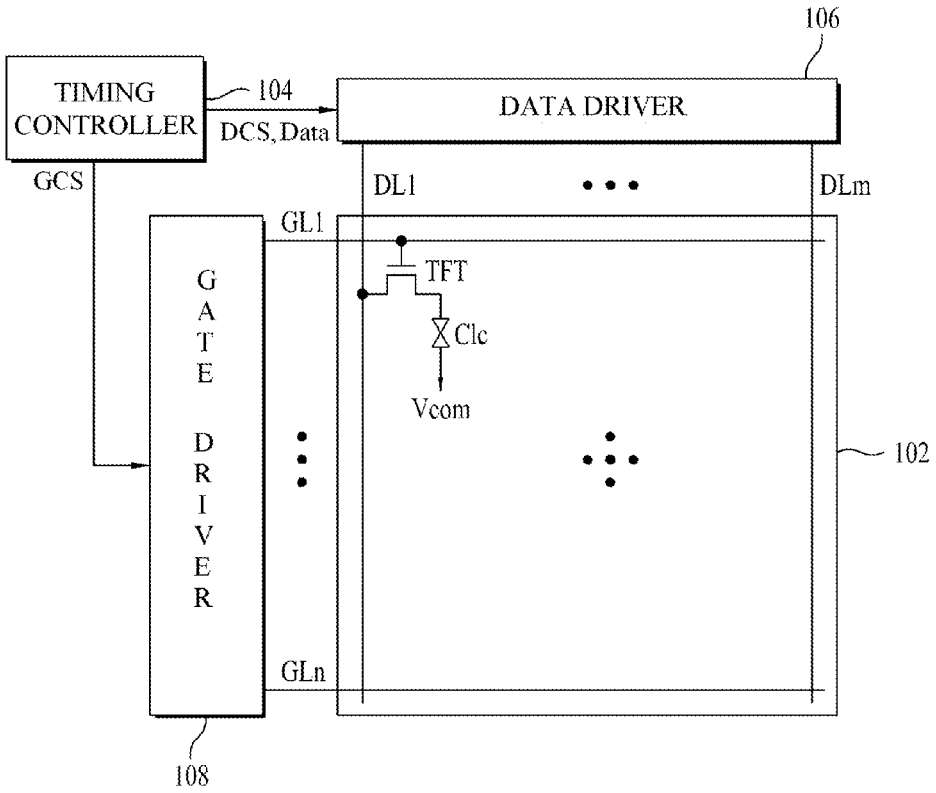
FIG. 1 is a block diagram showing a liquid crystal display device according to the present invention.

FIG. 1 is a block diagram showing a mobile liquid crystal display device using a mobile industry processor interface (MIPI) according to the present invention.

The liquid crystal display device shown in FIG. 1 includes a liquid crystal panel 102 to display images, a gate driver 108 and a data driver 106 to drive the liquid crystal panel 102, and a timing controller 104 to control the gate driver 108 and the data driver 106.

The liquid crystal panel 102 includes a matrix of liquid crystal cells Clc and thin film transistors TFT connected to gate lines GL1 to GLn and data lines DL1 to DLm to drive the respective liquid crystal cells Clc. The thin film transistors TFT of the liquid crystal panel 102 are turned on by gate-on voltage from the gate lines GL. As a result, data signals of the data lines DL are supplied to the liquid crystal cells Clc, and voltage equivalent to the difference between common voltage Vcom and the data signals is applied to the liquid crystal cells Clc. Also, the thin film transistors TFT are turned off by gate-off voltage. As a result, voltage applied to the liquid crystal cells Clc is maintained. The liquid crystal cells Clc drives liquid crystals based on the applied voltage to adjust light transmissivity so that images are displayed on the liquid crystal panel 102.

The gate driver 108 sequentially supplies gate-on voltage to the gate lines GL in response to a gate control signal GCS from the timing controller 104. In addition, the gate driver 108 supplies gate-off voltages to the gate lines GL for a period where the gate-on voltages are not supplied.

The data driver 106 converts digital data signals into analog voltage using data control signal DCS from the timing controller 104 and gamma voltage, and supplies the converted analog voltage to the data lines DL.

The timing controller 104 generates a gate control signal GCS and a data control signal DCS using a plurality of synchronizing signals input through a host (not shown) and supplies the generated signals to the gate driver 108 and the data driver 106. Also, the timing controller 104 arranges display data input from the host and supplies the arranged display data to the data driver 106.

Figure 2:
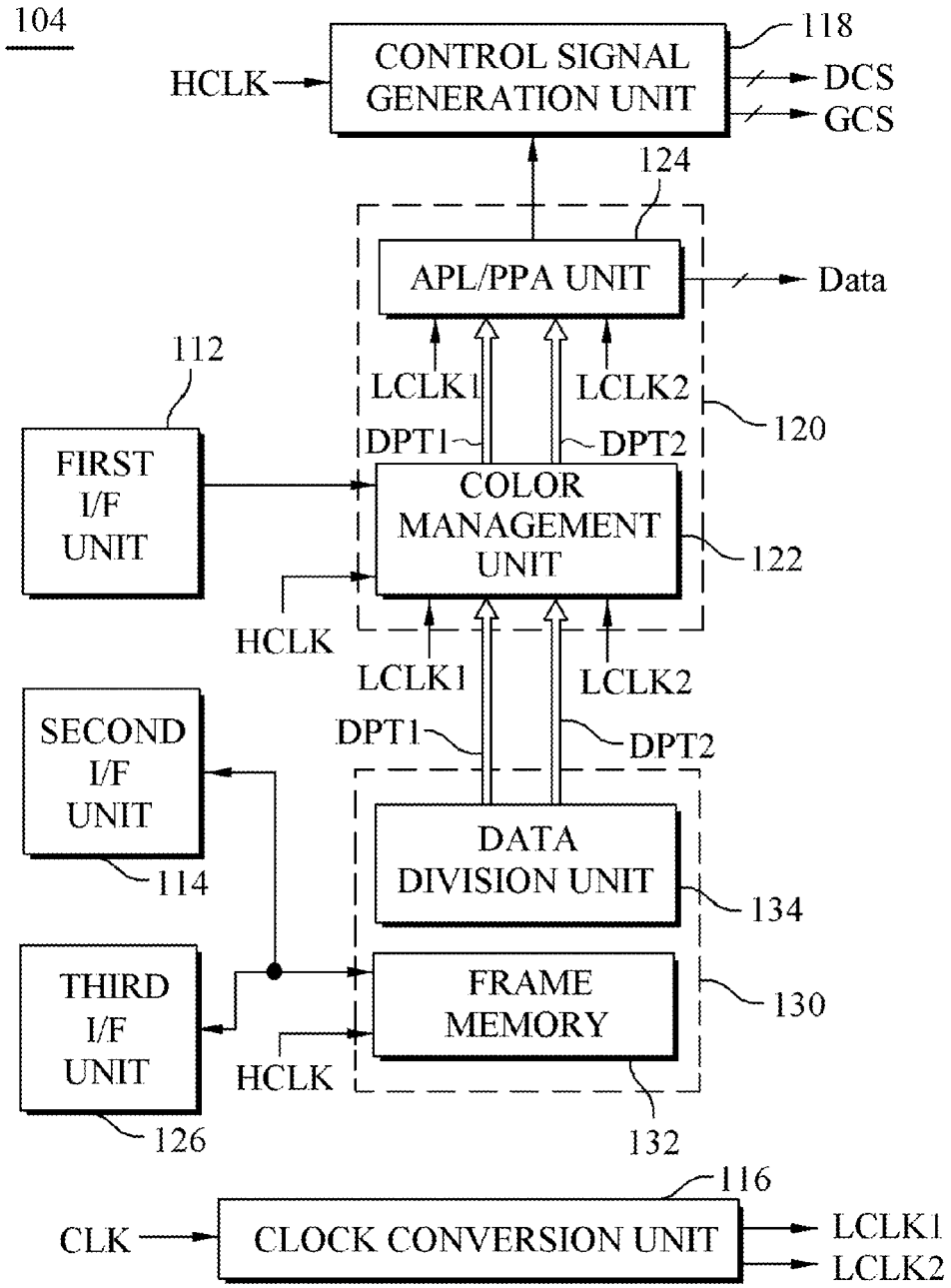
FIG. 2 is a block diagram showing a timing controller shown in FIG. 1 in detail.

As shown in FIG. 2, the timing controller 104 includes first to third interface units 112, 114 and 126, first and second data processing units 120 and 130, a control signal generation unit 118, and a clock conversion unit 116.

The clock conversion unit 116 generates first and second low-speed clock signals LCLK1 and LCLK2 having a lower speed than a reference clock signal CLK necessary to transmit data using the clock signal CLK. For example, since a reference clock signal CLK necessary to transmit data has a frequency of 25 MHz to realize a high resolution of WVGA (wide video graphic array) on a mobile display at 60 Hz, the first and second low-speed clock signals LCLK1 and LCLK2 have a frequency of 12.5 MHz.

The clock conversion unit 116 includes a phase locked loop (PLL) circuit to generate the first and second low-speed clock signals LCLK1 and LCLK2. The phase locked loop circuit locks the phase of an input signal to generate a fixed clock frequency. The phase locked loop circuit includes a phase detector, a low pass filter, an error amplifier and a voltage controlled oscillator. The phase locked loop circuit detects a phase difference between an input signal and an output signal, filters a high-frequency component of the detected phase difference signal to calculate direct current voltage equivalent to the phase difference, and applies the direct current voltage to an input of the voltage controlled oscillator so that the output frequency of the voltage controlled oscillator is automatically adjusted to compensate for deviated phase.

As described above, the phase locked loop circuit serves to correctly vary the frequency of a clock. Consequently, the clock conversion unit 116 including the phase locked loop circuit generates the first and second low-speed clock signals LCLK1 and LCLK2 having a frequency equivalent to half that of the reference clock signal CLK.

The first interface unit 112 is a display pixel interface DPI to receive command data including a timing synchronizing signal used to display such display data, such as parallel data bits DB, data enable DE, a vertical synchronizing signal VSYNC, a horizontal synchronizing signal HSYNC and a dot clock signal DCLK, from the host.

Command data supplied to the first interface unit 112 are supplied to a color management unit 122 through a port while being synchronized with a high-speed clock signal HCLK having a frequency lower than that of the reference clock signal CLK necessary to transmit data and higher than that of the first and second low-speed clock signals LCLK1 and LCLK2. For example, the high-speed clock signal HCLK has a frequency of 17 MHz to realize the timing controller 104 in low power consumption mode.

The second interface unit 114 is a display bus interface to receive command data including a synchronizing signal related to a mode to display such display data, such as parallel data bits DB, a chip select signal, a register select signal, a read signal RD and a write signal WR, from the host. Also, the second interface unit 114 transmits the command data to a frame memory 132 and receives transmission state or command data information from the frame memory 132. The command data supplied to the second interface unit 114 are supplied to the frame memory 132 in the first data processing unit 130 through a port while being synchronized with a high-speed clock signal HCLK.

The third interface unit 126 is a display serial interface to receive display data from the host in a series mode and to transmit the received display data to the frame memory 132. Also, the third interface unit 126 receives transmission state or display data information from the frame memory 132.

The first data processing unit 130 stores the display data from the third interface unit 126, divides the display data into first and second display data, and supplies the first and second display data to the second data processing unit 120. The first data processing unit 130 includes a frame memory 132 and a data division unit 134.

The frame memory 132 buffers the display data from the third interface unit 126 per frame and supplies the buffered display data to the data division unit 134.

Figure 3A:
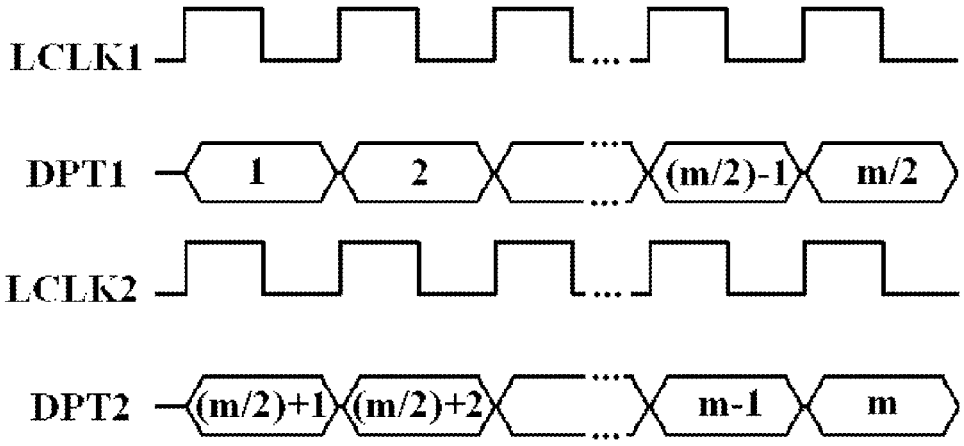
FIGS. 3A and 3B are view showing an embodiment of first and second display data supplied through first and second data ports shown in FIG. 2.
Figure 3B:
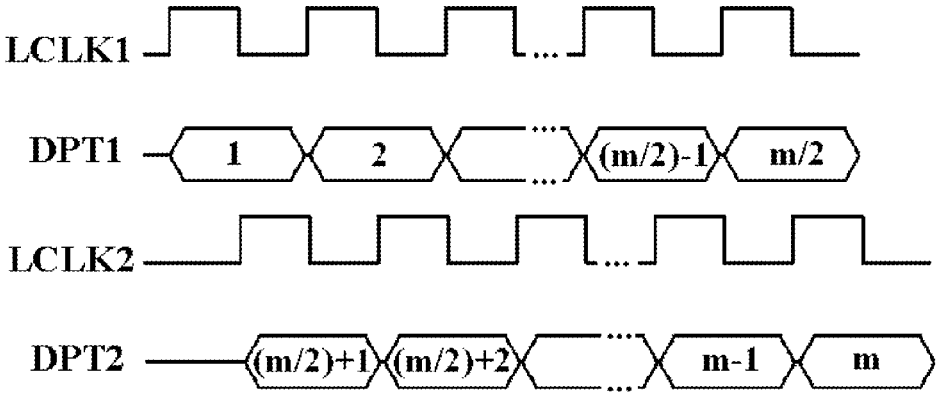

As shown in FIG. 3A or 3B, the data division unit 134 divides the display data from the frame memory 132 into first and second display data and supplies the first and second display data to the second data processing unit 120.

Specifically, the data division unit 134 divides m display data into first display data including first to m/2-th display data and second display data including (m/2)+1-th to m-th display data. As shown in FIGS. 3A and 3B, the first display data are transmitted to the second data processing unit 120 through a first data port DPT1 while being synchronized with a rising edge of the first low-speed clock signal LCLK1 from the clock conversion unit 116. The second display data are transmitted to the second data processing unit 120 through a second data port DPT2 while being synchronized with a rising edge of the second low-speed clock signal LCLK2. At this time, the second low-speed clock signal LCLK2 has a phase identical to that of the first low-speed clock signal LCLK1 as shown in FIG. 3A or reverse to that of the first low-speed clock signal LCLK1 as shown in FIG. 3B.

Figure 4A:
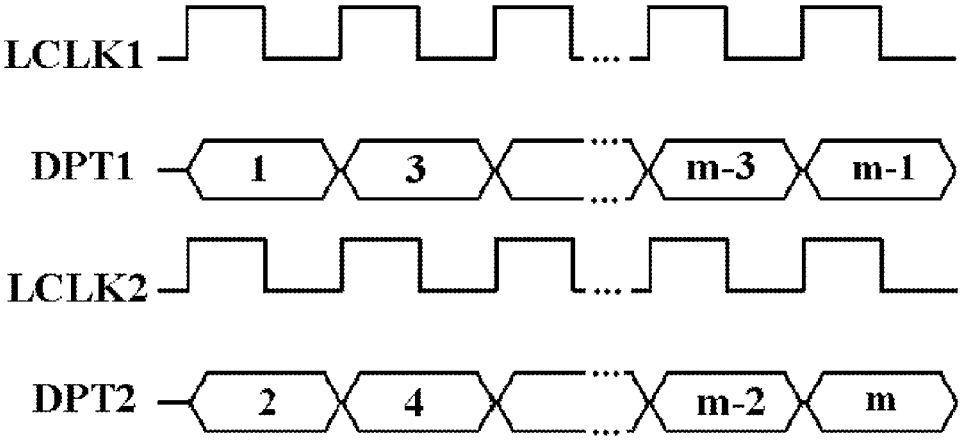
FIGS. 4A and 4B are view showing another embodiment of the first and second display data supplied through the first and second data ports shown in FIG. 2.
Figure 4B:
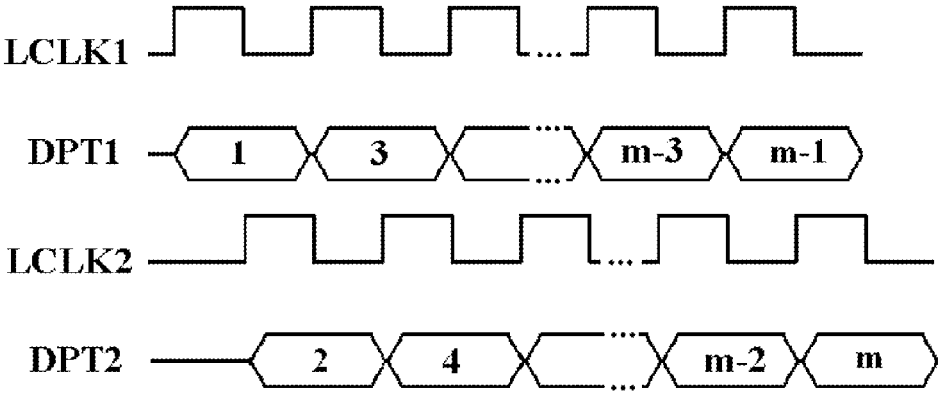

As described above, the data division unit 134 divides display data into first display data including first to m/2-th display data and second display data including (m/2)+1-th to m-th display data. Alternatively, as shown in FIGS. 4A and 4B, the data division unit 134 may divide display data into first display data including odd display data and second display data including even display data.

The second data processing unit 120 receives the command data from the first interface unit 112. Also, the second data processing unit 120 receives the first and second display data from the data division unit 134 through the first and second data buses DPT1 and DPT2, arranges the display data so to be suitable for the data driver 106 and supplies the arranged display data to the date driver 106. The second data processing unit 120 includes a color management unit 122 and an average picture level (APL)/pixel processing algorithm (PPA) unit 124.

The color management unit 122 removes discordance between colors of the first and second display data realized through the liquid crystal panel 102 and colors realized through an output apparatus, such as a scanner or a printer, through mapping of a color region, thereby achieving color matching. That is, the color management unit 122 converts the first and second display data input through the first and second data buses DPT1 and DPT2 based on color management data included in the command data. The converted first and second display data are transmitted to the APL/PAA unit 124 through the first and second data buses DPT1 and DPT2.

Specifically, as shown in FIGS. 3A and 3B, the first display data are transmitted to the APL/PAA unit 124 through the first data port DPT1 while being synchronized with a rising edge of the first low-speed clock signal LCLK1. The second display data are transmitted to the APL/PAA unit 124 through the second data port DPT2 while being synchronized with a rising edge of the second low-speed clock signal LCLK2. At this time, the second low-speed clock signal LCLK2 has a phase identical to that of the first low-speed clock signal LCLK1 as shown in FIG. 3A or reverse to that of the first low-speed clock signal LCLK1 as shown in FIG. 3B.

Figure 5:
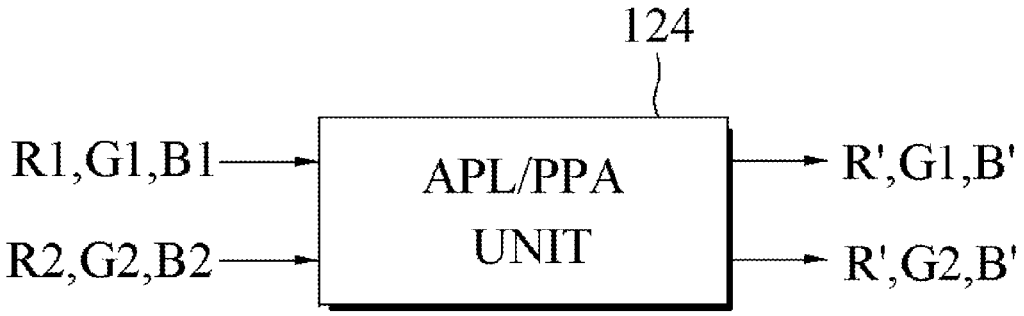
FIG. 5 is a view illustrating an average picture level (APL)/pixel processing algorithm (PPA) unit shown in FIG. 2 in detail.

As shown in FIG. 5, the APL/PAA unit 124 extracts average brightness values of red and blue color data R1, R2, B1 and B2 of the first display data including red, green and blue color data R1, G1 and B1 and the second display data including red, green and blue color data R2, G2 and B2 to calculate APL. The red and blue color data R1, R2, B1 and B2 are modulated based on the calculated APL. The modulated red and blue color data R' and B' and the green data G1 and G2 of the first and second display data are mixed, rearranged, and transmitted to the data driver 106.

The control signal generation unit 118 generates a data control signal DCS and a gate control signal GCS using synchronizing signals DE, HSYNC, VSYNC and DCLK from the command data and supplies the generated data and gate control signals to the data driver 106 and the gate drive 108, respectively.

In the present invention, as described above, the first display data are transmitted through the first data port DPT1 while being synchronized with the first low-speed clock signal LCLK1, and the second display data are transmitted through the second data port DPT2 while being synchronized with the second low-speed clock signal LCLK2, between the data division unit 134 and the color management unit 122 and between the color management unit 122 and the APL/PPA unit 124, respectively. Consequently, a transmission frequency of the display data and the low-speed clock signal is reduced, and therefore, it is possible to reduce EMI and noise. In addition, it is possible to transmit data at high speed, thereby realizing high resolution.

Meanwhile, in the present invention, the timing controller 104 and the data driver 106 may be realized as one chip. Although the liquid crystal display device has been described as an example in the above, the present invention may be applied to an organic electroluminescent display device, a plasma display device or an electrophoretic display device.

As is apparent from the above description, in the display device according to the present invention, display data are divided into N data, and clock signals are divided into N low-speed clock signals in response to the divided display data and are supplied. That is, first display data are transmitted through a first data port while being synchronized with a first low-speed clock signal, and second display data are transmitted through a second data port while being synchronized with a second low-speed clock signal. Consequently, it is possible to reduce a transmission frequency of the display data and the low-speed clock signals, thereby reducing EMI and noise. Also, it is possible to transmit data at high speed, thereby realizing high resolution.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A display device comprising:

a display panel to display images;

a gate driver to drive gate lines of the display panel;

a data driver to drive data lines of the display panel;

a timing controller to control the gate driver and the data driver and to arrange and supply display data to the data driver; and N (N is a natural number greater than 1) data ports to transmit the display data while being synchronized with N low-speed clock signals having a lower frequency than a clock signal necessary to transmit the display data in the timing controller, wherein the timing controller comprises:

a clock conversion unit to generate first and second low-speed clock signals having a frequency equivalent to half that of the clock signal necessary to transmit the display data;

a first data processing unit to store the display data and to divide the display data into first display data and second display data; and a second data processing unit to receive the first display data and second display data from the first data processing unit through the N data ports and to supply the first display data and second display data to the data driver, and wherein command data including a synchronizing signal are supplied to the first and second data processing units while being synchronized with a high speed clock signal having a frequency lower than that of the clock signal and higher than that of the N low-speed clock signals.

2. The display device according to claim 1, wherein the first data processing unit comprises:

a data division unit to divide the display data into first display data and second display data; and wherein the second data processing unit comprises:

a color management unit to convert the first display data and second display data based on color management data; and an average picture level/pixel processing algorithm unit to adjust brightness components of the first display data and second display data and to arrange and transmit the first display data and second display data to the data driver.

3. The display device according to claim 2, wherein first and second data ports are formed between the data division unit and the color management unit and between the color management unit and average picture level/pixel processing algorithm unit, respectively, the first data port transmits the first display data while being synchronized with the first low-speed clock signal, and the second data port transmits the second display data while being synchronized with the second low-speed clock signal.

4. The display device according to claim 3, wherein the first low-speed clock signal has a phase identical to that of the second low-speed clock signal.

5. The display device according to claim 4, wherein the data division unit divides the display data into the first display data comprising first to m/2-th display data and the second display data comprising (m/2)+1-th to m-th display data.

6. The display device according to claim 4, wherein the data division unit divides the display data into the first display data comprising odd display data and the second display data comprising even display data.

7. The display device according to claim 3, wherein the first low-speed clock signal has a phase reverse to that of the second low-speed clock signal.

8. The display device according to claim 7, wherein the data division unit divides the display data into the first display data comprising first to m/2-th display data and the second display data comprising (m/2)+1-th to m-th display data.

9. The display device according to claim 7, wherein the data division unit divides the display data into the first display data comprising odd display data and the second display data comprising even display data.

* * * * *